US005570938A

United States Patent [19]

Butler

[11] Patent Number: 5,570,938

[45] Date of Patent: Nov. 5, 1996

[54] TOILET PAPER ROLL HOLDER

[76] Inventor: Curtis P. Butler, P.O. Box 193461, Little Rock, Ark. 72219

[21] Appl. No.: 385,102

[22] Filed: Feb. 7, 1995

[51] Int. Cl.[6] ..... A47F 1/00; A47F 3/02; B65D 83/08; B65G 1/16

[52] U.S. Cl. ..... 312/45; 312/34.1; 312/34.8; 312/34.22; 312/34.24; 312/242; 312/245; 312/321.5; 248/309.2; 211/59.1; 211/88; 242/594.3; 242/594.4; 242/599.1

[58] Field of Search ..... 312/45, 321.5, 312/34.1, 34.8, 34.22, 34.24, 242, 245, 114; 248/309.2; 211/59.1, 88; 242/594.3, 594.1, 559.1; D6/512, 518, 520, 521

[56] References Cited

U.S. PATENT DOCUMENTS

| | | | |
|---|---|---|---|
| D. 154,900 | 8/1949 | Boord | D6/520 |
| D 205,184 | 7/1966 | Johnson | D6/520 X |
| D 229,805 | 1/1994 | James | D6/520 |
| 1,371,193 | 3/1921 | Berge | 312/242 |
| 1,408,054 | 2/1922 | Williams | 312/242 X |
| 1,441,410 | 1/1923 | Eustis | 312/242 |
| 1,976,037 | 10/1934 | Rawlings . | |
| 2,527,101 | 10/1950 | Maddox | 312/114 X |
| 2,553,389 | 5/1951 | Steiner et al. . | |
| 2,555,531 | 6/1951 | Boord | 211/59.1X |
| 2,872,125 | 2/1959 | Rial et al. | D6/518 X |
| 2,991,951 | 7/1961 | Carroll . | |
| 3,295,777 | 1/1967 | Carroll . | |
| 3,370,805 | 2/1968 | Barbee | 248/309.2 X |
| 4,273,392 | 6/1981 | Stinson . | |
| 4,614,374 | 9/1986 | Lannert et al. | 312/242 X |
| 4,898,335 | 2/1990 | Eysink | 242/594.3 |

*Primary Examiner*—Peter M. Cuomo
*Assistant Examiner*—Rodney B. White
*Attorney, Agent, or Firm*—Ray F. Cox, Jr.

[57] ABSTRACT

A holder for storing multiple rolls of toilet paper in a box-like enclosure mounted to a wall, either to the surface of the wall or in a recess. The enclosure is provided with a tilt-out front panel and an integral floor having multiple rods affixed orthogonally to the floor for receiving the open central cores of toilet paper rolls. The entire assembly comprising the front panel, the floor and rods tilt out as a unit to provide access the stored toilet paper rolls.

4 Claims, 3 Drawing Sheets

TOILET PAPER ROLL HOLDER

FIELD OF THE INVENTION

The present invention relates to storage devices and in particular to holders for storing a plurality of toilet paper rolls.

BACKGROUND OF THE INVENTION

The storage of toilet paper rolls in a typical home or commercial establishment is a problem due to the bulk and unsightliness of large quantities of toilet paper rolls. The storage of rolls of toilet paper typically requires the use of large amounts of storage space under a vanity or in a closet or similar location.

It is therefore desirable to find a way of storing toilet paper rolls neatly and tastefully without interfering with storage space that may be more readily applied to other purposes. It is also desirable to have a means of storing toilet paper rolls such that the rolls are easily accessible.

A number of issued United States patents embody the concept of using a rod or dowel to assist in the storage of multiple rolls of toilet paper by receiving the center core of the rolls over the rod or dowel. Although not specifically directed to the storage of toilet paper, U.S. Pat. No. 1,976,037 issued to Rawlings on Oct. 9, 1934 for "Spool Holder or the Like" discloses a container which has a pivoting rod for holding multiple rolls of spools, bobbins or the like. Rawlings does not disclose the use of multiple rods, nor does it disclose an arrangement in which the rod or rods are integral with a front panel and floor all of which may be pivoted out as a unit.

Other patents which disclose a toilet paper storage container having a vertical rod or dowel are U.S. Pat. Nos. 3,295,777 and 2,991,951. These two patents, however, also disclose an integral dispensing mechanism and are therefor not directed primarily to storage of toilet paper rolls.

U.S. Pat. No. 2,553,389 issued to Steiner on May 15, 1951 for "Holder for Dispensing Material in Roll Form" discloses a container wherein the outside cover pivots forward for access to the storage space containing a vertical rod. The rod or dowel does not, however, pivot forward with the exterior cover of the container.

U.S. Pat. No. 2,872,125 issued to Rial on Feb. 3, 1959 for "Apparatus for Storing and Dispensing Sheet Material in Roll Form" does, however, disclose a toilet paper storage container which pivots forward for placing the toilet paper rolls in position inside the container. A post inside the storage container for receiving the lower-most toilet paper roll tilts forward with the container for easy insertion of the toilet paper rolls. Dispensing of the toilet paper rolls, however, does not rely on the same mechanism. Rather than pivoting the container forward to obtain access to the stored toilet paper rolls, the post tilts forward independently to allow the removal of an empty toilet paper roll core and then tilts back into position to receive the next toilet paper roll.

U.S. Pat. No. 4,273,392 discloses a container with a vertical rod for storing multiple toilet paper rolls. This patent discloses, however, that the toilet paper rolls are removed simply by lifting the rod from the storage container. Neither the container itself nor the rod pivots.

SUMMARY OF THE INVENTION

To overcome the disadvantages and limitations of the prior art, the present invention provides for a storage container for multiple rolls of toilet paper. The container is basically a box-like enclosure which may be mounted to a wall. The enclosure may be mounted either to the surface of a wall or may be mounted within a recess of the wall. The enclosure may be sized to hold varying quantities of toilet paper rolls. The enclosure is provided with a tilt-out front panel for access to the stored toilet paper rolls. In the preferred embodiment, the tilt-out front panel is integral with a bottom or floor. A plurality of vertical rods arranged side by side are affixed to the bottom or floor. The entire assembly comprising the front panel, bottom and vertical rods all pivot together as a unit to provide access to the rolls of toilet paper which are stored by being stacked on the vertical rods. When closed, the front panel and bottom together with the enclosure form a substantially enclosed space protecting and concealing the rolls of stored toilet paper. By tilting out the front panel, the stored rolls are accessible and may be replenished as needed.

BRIEF DESCRIPTION OF THE DRAWINGS

Additional objects and advantages of the present invention are apparent from the following detailed description of the preferred embodiments, along with the accompanying drawings in which.

DETAILED DESCRIPTION OF THE PREFERRED EMBODIMENTS

Figure 1:
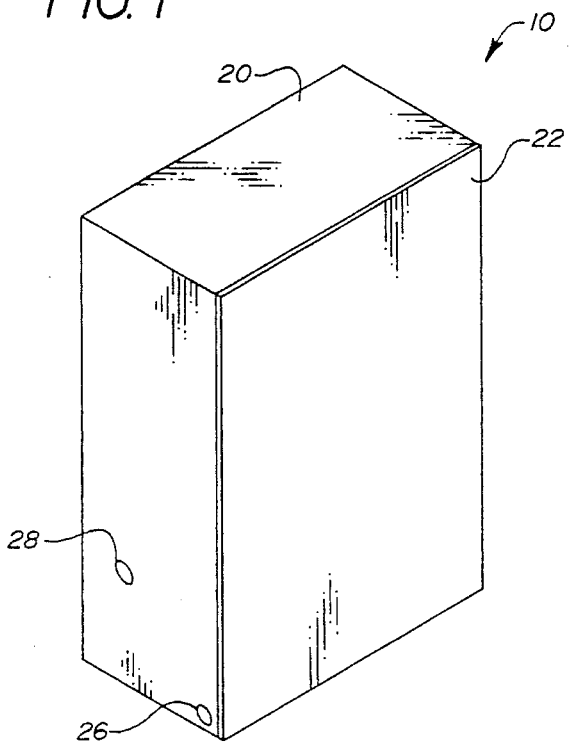
FIG. 1 is a perspective view of the holder in the closed position.

The various components of the preferred embodiment of the present invention may be described with reference to FIG. 7. An enclosure 20 comprises a back, top and a pair of sides. A support assembly comprises a front panel 22 and a bottom panel 24 integral therewith. The support assembly comprising the front panel 22 and the bottom panel 24 are pivotally mounted to the enclosure 20. In one embodiment of the invention, hinge pivot blocks 27 attached to the bottom panel 24 proximally to the front panel 22 receive hinge pins 26 through the lower front portion of the enclosure 20. Other means of pivotally mounting the front panel 22 and bottom panel 24 to the enclosure 20 would be acceptable and are considered to be comprised within the scope of the present invention.

By placing the pivot point close to the lower front portion of the enclosure 20 and pivoting about a point close to the juncture of the front panel 22 and the bottom panel 24, as advantage feature is obtained since weight bearing on the bottom panel 24 will tend to keep the front panel 22 closed against the face of the enclosure 20. In this closed position, the enclosure 20, the front panel 22 and the bottom panel 24 form an essentially enclosed space wherein the toilet paper rolls 32 may be stored out of sight and with little danger of environmental contamination. In the preferred embodiment, the front panel 22 is held tightly closed against the enclosure 20 simply by the weight of the support assembly and toilet paper rolls 32 stored within. Other means to bias the front panel 22 into a closed position, such as springs or catches, would be considered comprised within the scope of the present invention.

For ease in storing the toilet paper rolls 32 in an organized and accessible fashion, a plurality of support rods 30 are attached to the bottom panel 24 such that the support rods 30 are essentially orthogonal to the bottom panel 24. In the preferred embodiment, the support rods 30 are attached to the bottom panel 24 by means of screws 31 through the bottom panel 24 into the support rods 30. The method of attachment of the support rods 30 to the bottom panel 24 is not critical and other means of attachment would be perfectly acceptable. For example, the support rods 30 and the bottom panel 24 may be molded as a single integral piece. One or more support rods 30 may be employed in various embodiments of the invention. The support rods 30 are sized so that the open central cores of the toilet paper rolls 32 may be received thereon. In addition, the support rods 30 are spaced relative to each other and to the front panel 22 so as to receive the toilet paper rolls 32 without interference from the next support rod 30 or from the front panel 22. It is to be noted that toilet paper rolls vary in size and therefore for maximum utility the support rods 30 should be located so that the largest typical size of toilet paper roll used in the particular establishment may be accommodated.

Figure 6:
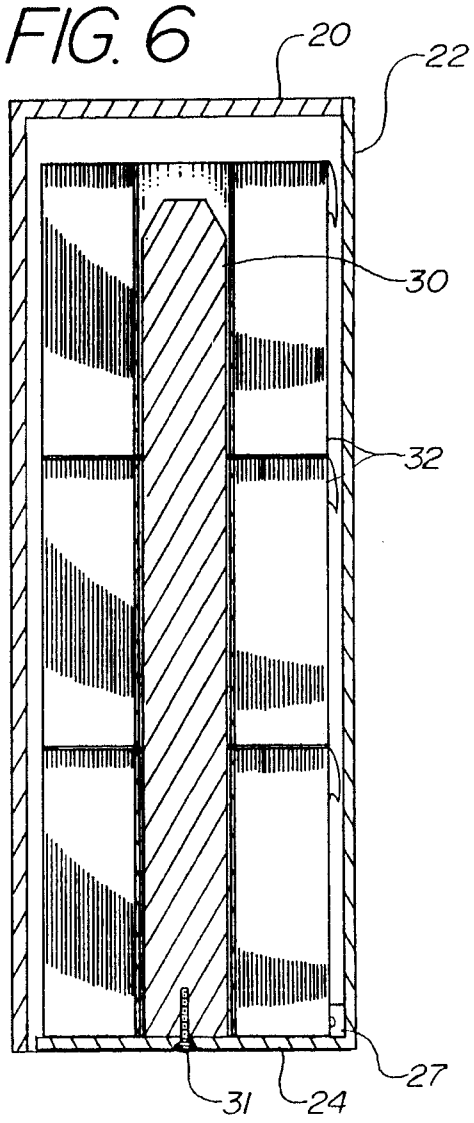
FIG. 6 is a sectional side elevation of the holder in the closed position showing rolls of toilet paper stored therein.
Figure 5:
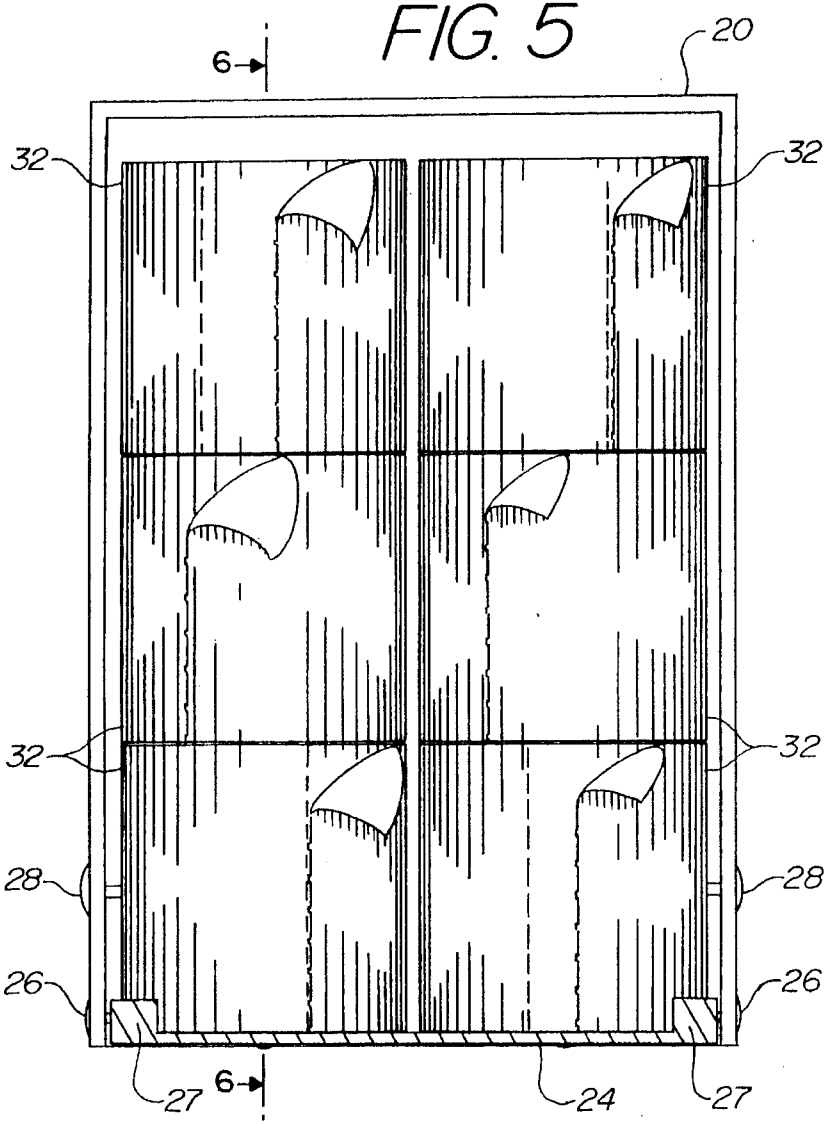
FIG. 5 is a sectional front elevation of the holder in the closed position showing rolls of toilet paper stored therein.

As may be seen by reference to FIGS. 5 and 6, a plurality of toilet paper rolls 32 may be stacked vertically on each support rod 30. In addition, a plurality of support rods 30 may be arranged side by side to provide optimum utilization of storage space.

Figure 7:
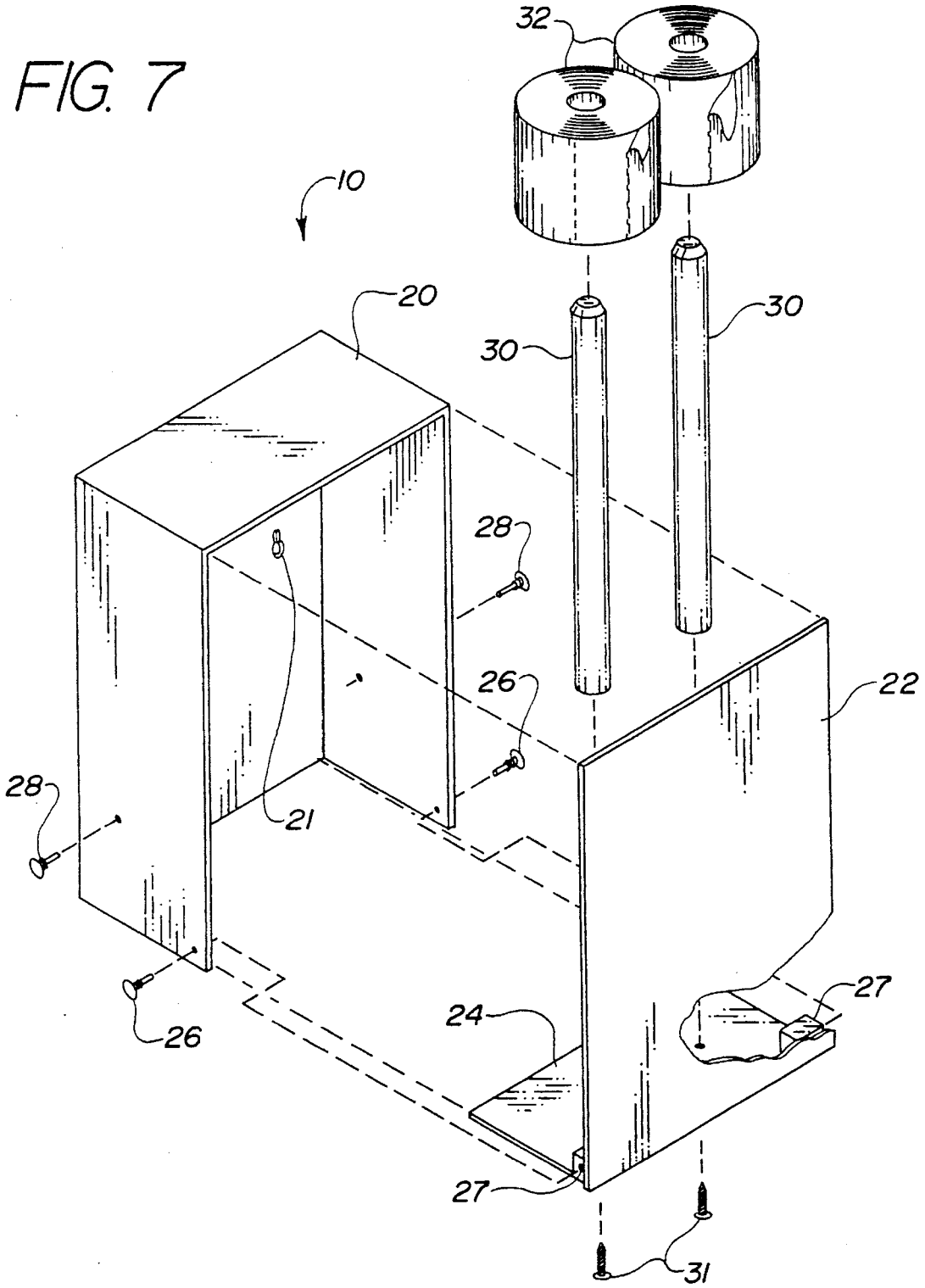
FIG. 7 is an exploded perspective view of the holder.

With further reference to FIG. 7, it is to be noted that the support assembly comprising the front panel 22 and the bottom panel 24 does not require either side or rear walls and, in fact, such additions to the support assembly would hinder access to the stacked rolls of toilet paper 32.

Figure 4:
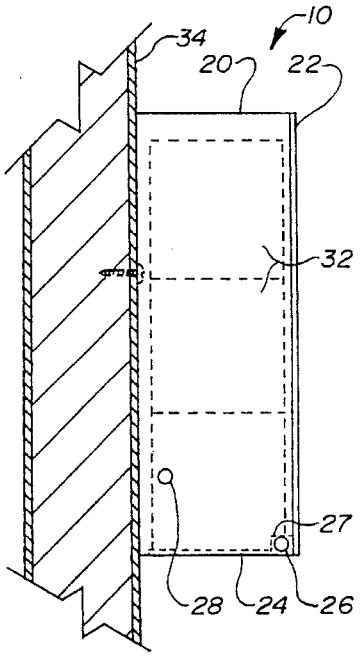
FIG. 4 is a side elevation of the holder in the closed position as mounted to the surface of a wall.

In the preferred embodiment, the holder 10 is intended to be mounted to a vertical wall 34. In one embodiment as shown in FIG. 4, the rear panel of the enclosure 20 is provided with one or more keyhole slots 21 which may be employed to fasten the holder 10 to the surface of the vertical wall 34 using screws.

Figure 3:
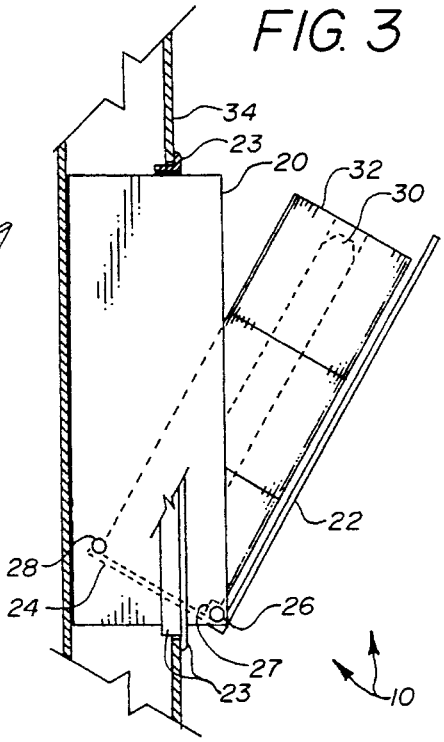
FIG. 3 is a side elevation of the holder in the open position as mounted within a wall recess.

An alternative embodiment of the holder 10 may be mounted within a recess of the wall 34 as shown in FIG. 3. In the recessed configuration, a mounting flange 23 may be used to support the holder 10 within the wall recess.

Figure 2:
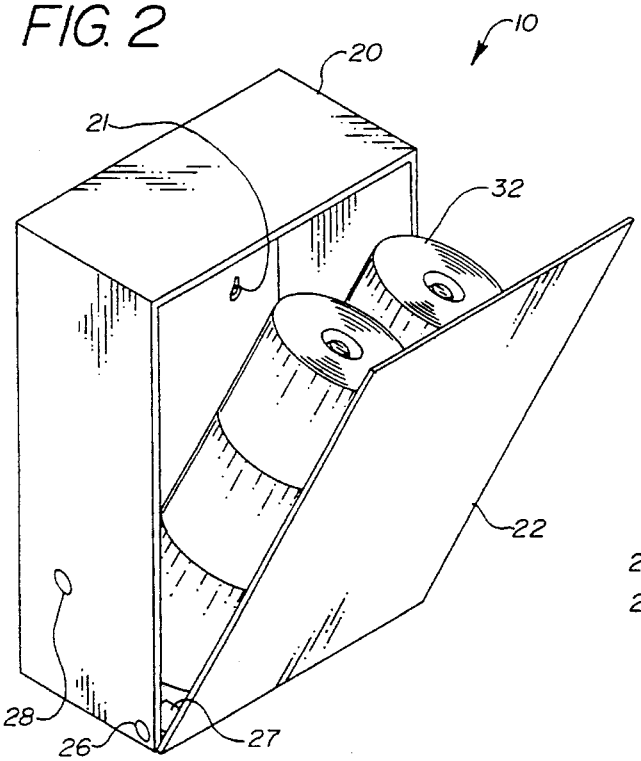
FIG. 2 is a perspective view of the holder in the open position showing stored rolls of toilet paper therein.

In use, the holder 10 will normally be biased into a closed position as is shown in FIG. 1 wherein the front panel 22 is held tightly closed against the enclosure 20. In order to obtain access to the stored toilet paper rolls 32, the front panel 22 may be manually pivoted outward. Alternatively, the front panel 22 may be provided with appropriate knobs, handles or other hardware to assist in pivoting the front panel 22. Since the front panel 22, the bottom panel 24 and the support rods 30 are all integrated as a single unit, they will tilt outward as a unit thereby allowing the user access to the stored toilet paper rolls 32. In the open position as shown in FIG. 2, the stored toilet paper rolls 32 may be manually removed from the support rods 30 or the supply of toilet paper rolls 32 may be replenished.

When the front panel 22 is tilted forward to a sufficient extent, the weight of the front panel 22, the support rods 30 and the stored toilet paper rolls 32 will be sufficient to hold the support assembly in an open position. In order to prevent the support assembly from rotating too far forward, a stop mechanism may be desirable. In one embodiment, the stop mechanism comprises stop pins 28 in the side walls of the enclosure 20 which protrude into the interior space in such a position as to intercept the travel of the bottom panel 24 at the maximum open position. Other forms of the stop mechanism could be acceptably employed.

While in some applications it would be desirable to maintain the enclosure 20 and the front panel 22 opaque to avoid the visual appearance of the stored toilet paper rolls 32, in other applications it would be desirable to be able to see at a glance the number of stored toilet paper rolls 32 at a given time. In these applications an alternative embodiment of the present invention would provide for a transparent front panel 22.

Although the present invention has been described with reference to certain preferred and alternative embodiments, such should be considered exemplary only and not limiting to the full scope of the present invention as set forth in the appended claims.

What is claimed is:

1. A toilet paper holder for holding a plurality of rolls of toilet paper having open cores comprising:

an enclosure having a pair of sides, a top and a back, and further having means for mounting said enclosure to a vertical wall;

a toilet paper roll support assembly comprising a front panel and integral therewith a bottom panel having an inner surface such that said bottom panel is not pivotally movable with respect to said front panel, said support assembly being pivotally mounted to said enclosure such that said support assembly is pivotally movable between a first position wherein said enclosure in combination with said support assembly forms an essentially enclosed space sized to contain a plurality of toilet paper rolls and a second position wherein the toilet paper rolls are accessible for removal; and one or more support rods immovably affixed orthogonally to the inner surface of said bottom panel and parallel to said front panel, said support rods extending substantially the full height of said front panel, and sized for receiving the open cores of a plurality of rolls of toilet paper whereby a plurality of rolls may be stacked onto said rods and manually removed therefrom.

2. The holder of claim 1 wherein said front panel is essentially transparent.

3. The holder of claim 2 wherein said means for mounting comprises means for mounting said enclosure to a wall surface.

4. The holder of claim 2 wherein said means for mounting comprises means for mounting said enclosure within a wall recess.

* * * * *